US005356007A

United States Patent [19]

Feldt

[11] Patent Number: 5,356,007

[45] Date of Patent: Oct. 18, 1994

[54] PACKAGE OF SHIRRED FOOD CASING AND METHOD

[75] Inventor: Raymond A. Feldt, Hickory Hills, Ill.

[73] Assignee: Viskase Corporation, Chicago, Ill.

[21] Appl. No.: 112,527

[22] Filed: Aug. 27, 1993

[51] Int. Cl.[5] ..... B65D 71/06; B65D 85/20

[52] U.S. Cl. ..... 206/443; 53/412; 53/444; 206/497; 206/499; 206/802; 229/87.05

[58] Field of Search ..... 206/443, 802, 83.5, 206/442, 497, 499; 229/87.05; 53/412, 444, 149, 540

[56] References Cited

U.S. PATENT DOCUMENTS

| | | | |
|---|---|---|---|
| 3,218,764 | 11/1965 | Deeren et al. | 206/443 X |
| 3,342,322 | 9/1967 | Weisner et al. . | |
| 3,764,351 | 10/1973 | Whittington et al. . | |
| 3,971,187 | 7/1976 | McNeill et al. . | |
| 4,648,513 | 3/1987 | Newman | 229/87.05 X |
| 5,137,153 | 8/1992 | Hendriks . | |
| 5,228,572 | 7/1993 | Hendriks | 206/443 |

FOREIGN PATENT DOCUMENTS

| | | | |
|---|---|---|---|
| 1056319 | 6/1979 | Canada . | |
| 1984071 | 11/1967 | Fed. Rep. of Germany . | |
| 2807906 | 8/1979 | Fed. Rep. of Germany | 206/443 |

*Primary Examiner*—Bryon P. Gehman
*Attorney, Agent, or Firm*—Roger Aceto

[57] ABSTRACT

A package of shirred food casing sticks Wherein the sticks are bundled together by a wrap disposed in tension transversely about the bundle and the opposite ends of the wrap are overlapped and releasably connected. The releasable connection attaches the outer surface of the underlying wrapper end to the inner surface of the overlying wrapper end and the overlying end having an outer margin which is free and loose from the connection to provide a means for grasping and pulling the overlying end free of the connector.

22 Claims, 4 Drawing Sheets

PACKAGE OF SHIRRED FOOD CASING AND METHOD

TECHNICAL FIELD

The present invention relates to a package of shirred food casings and more particularly to a package including a hexagonal bundle of shirred casings retained in an easy to open plastic bag.

BACKGROUND OF THE INVENTION

Small diameter sausages such as frankfurters or the like usually are made using food casings of cellulose. Cellulose food casings and the like customarily are manufactured in long continuous tubular lengths. For handling convenience, these long tubular lengths are gathered into pleats by shirring and are longitudinally compressed by known techniques to obtain a shorter, relatively rigid tubular element known in the industry as a shirred casing stick. The coherency of a shirred stick is derived in part from the shirring operation which forms the casing into generally conical pleats which nest one within another.

During a stuffing operation the stick is loaded onto a stuffing horn and a food emulsion is fed through the horn and into casing which is drawn forward from the stick by the stuffing pressure. It is not uncommon for a shirred stick 50 cm long to contain upwards of 50 meters or more of casing so a large number of individual frankfurters are made with each stick.

Packaging and shipping of shirred sticks presents several problems particularly for the type of casings used for frankfurters. These casings generally have a wall thickness of only about 0.025 mm to about 0.05 mm and shirred sticks of this casing are relatively fragile in that the nested pleats of casing formed by the shirring operation are easily separated or pulled apart. If the pleats separate, the stick is said to break or lose "coherency". The result is one or more rigid shirred sections connected by loose unshirred sections. Sticks in this condition are not easily loaded onto a stuffing horn and are not at all suitable for automatic stuffing operations wherein the stick is loaded onto a stuffing horn by mechanical means. Accordingly, the packaging for the shirred sticks must be able to minimize stick breakage.

Shirred sticks also are susceptible to damage if made wet. Since stuffing machines frequently are hosed down with water after a stuffing operation, any sticks in the area must be retained in packaging which provides a barrier to water spray and is not itself damaged by water contact.

In commercial practice it generally is customary to package sticks in tight bundles of fifty (50) sticks. Bundling sticks together accomplishes several functions. For example, a tight bundle helps to prevent bowing of individual sticks. Bowing is the result of a number of factors known in the art and is cause for concern because a bowed stick may not load onto a stuffing horn. A tight bundle further tends to reduce the likelihood of stick breakage as long as the bundle remains intact.

Conventional packaging for retaining a stick bundle generally is a carton or box comprising a combination of corrugated fiber board and a plastic wrap such as a shrink or stretch wrap. Corrugated fiber board cartons are substantially rigid and are recloseable so unused sticks remaining after a stuffing operation can be returned to the carton. Thus, if the stuffing operation consumes fewer than fifty sticks, the unused remaining sticks are usually loosely laid back into the carton. However, the returned sticks which are loose in the carton may bow and are more susceptible to damage. Also, the carton, when partly filled, takes up the same space as a full carton due to the rigidity of the corrugated fiber board. Corrugated fiber board has the further drawbacks of adding bulk and expense to the packaging and unless it is treated, the material is susceptible to water damage. The presence of corrugated fiber board dust in a food processing kitchen also is objectionable. Accordingly, it is not uncommon for a food process to unload such cartons outside the kitchen area and then carry loose casing sticks into the kitchen for use. In another packaging system as shown in U.S. Pat. No. 3,764,351, rigid end panels are placed against the end of the bundle and then the bundle is held together with the rigid end panels by a shrink film. The integrity of the resulting package is destroyed when the film is torn for opening the package.

Shirred sticks are sold in a number of different diameters and lengths. While packages of fifty sticks are most common, counts of less than fifty sticks are usual for certain sizes of casings. Accordingly, different sizes of cartons and/or carton components must be kept in inventory to provide the appropriate packaging for a given number of each particular size (diameter and length) of stick. The need to obtain and stockpile carton or carton components in a variety of sizes adds to the packaging costs.

U.S. Pat. No. 5,137,153 discloses a package of shirred sticks having a hexagonal-like cross section. The sticks are secured by a restraining means such as a wrap of paper, plastic film, net or bands which applies radial pressure to hold the sticks together. While the package as disclosed in this patent reduces the use of corrugated packaging material, it is not entirely satisfactory. For example, once the restraining means is opened, the structure lacks a repackaging feature so other accommodations must be made for storage of unused sticks.

Another prior art package, as disclosed in U.S. patent application Ser. No. 08/030,923, uses a heat shrinkable film to form a container in situ about a bundle of shirred sticks. Heat shrinking causes the film to assume the shape of the bundle and the resulting container encloses the bundle of sticks on all sides. Further, the container formed in this fashion is self supporting so after sticks are removed it still provides a receptacle into which unused sticks can be placed for storage.

While this packaging provides an alternative to conventional shirred stick packaging it has certain drawbacks. For example, when the film shrinks, it draws tight around the corners of the bundle. This has the effect of capturing the ends of individual sticks which could restrict dispensing from the container. Also, while heat shrinking to form a tight package is acceptable, exposure of the casing to heat shrinking temperatures is not preferred and the energy requirements for heat shrinking adds to the packaging costs.

The present invention provides a package which maintains the integrity of a bundle of shirred casing sticks without use of bulky corrugated fiberboard or the like and provides a method for forming the package which is less energy intensive than heat shrinking. Moreover, the package of the present invention encloses the bundle of sticks, opens easily and when open, allows sticks to dispense freely. After opening, the package retains its integrity so that unused sticks are easily returned to the package.

The package of the present invention includes a stack of shirred sticks bundled together by a plastic film which is transversely wrapped tightly about the bundle. This tight wrapping is accomplished preferably by using a stretch film and placing it in tension about the bundle. A tight wrap also can be accomplished using a shrink film where the film is more loosely disposed about the bundle and then heat shrunk to tighten it. In both cases, the film enwrapment exerts radial pressure on the stack to hold the bundle together and to prevent the movement of shirred sticks in the bundle one relative to another.

Opposite ends of the film overlap along the top of the bundle. The overlapped ends are united and held together by any suitable mechanical or adhesive connector to maintain the wrap in tension about the bundle. The connector, for purposes of the present invention, is releasable to permit easy opening of the package and is resealable to permit reclosing the package.

For example, a mechanical connector can take the form of interlocking male and female strips along the overlapped ends of the film. An adhesive bond also can be used as the connector to unite the ends of the film. The adhesive bond can be formed by any suitable single or double sided tape or by laying a bead of adhesive along one or both of the opposite edges so that one edge can releasably adhere to the other. If a double sided tape or bead of adhesive is used, it can be disposed between the overlapped ends so it is adhered to the outer surface of the underlayer of film and to the inner surface of the overlayer of film.

In a preferred arrangement, the connector is a single sided tape that extends along the length of the bundle and is adhered to the inner surface of both the overlayer and underlayer. The tape is located so one half its width is adhered to the inner surface of the underlayer. The other half of tape width extends out from under the edge of the underlayer. After the overlayer is pulled tight around the bundle, it is pressed down against, and adhered to, the exposed surface of the adhesive tape.

As an alternative, a single sided tape can be used which extends the full length of the bundle so one half the width of the adhesive surface is adhered to the outer surface of both the overlayer and underlay of film. This arrangement, while functional, is not preferred for several reasons. For example, this arrangement does not lend itself to incorporation of an easy open feature. Also, when the package is opened, the adhesive side of the tape is toward the casing sticks so the casings could come into contact with the adhesive when the casings are dispensed. Further, the tape on the outside of the package is susceptible to damage or partial removal when several such packages are all loaded into a common container. Moreover, to open the package, the tape for at least part of its length must be removed. Once removed from the package the tape is difficult to reuse unless care is taken to keep the tape from sticking to itself.

When disposed tight about the bundle, the length of the wrapping film is longer than the perimeter of the bundle of sticks so an end portion of the overlayer extends beyond the adhesive or mechanical connector to provide a loose flap of film material. This flap extends substantially the full length of the bundle. If a sufficient length of film is provided, this loose flap functions as a means to facilitate opening the package. In this respect, the flap is gripped and pulled to separate the connector so the package opens its full length. In the preferred arrangement noted above, an adhesive tape, being adhered along half its width to the underlayer, remains with the underlay and is not removed. After sticks are dispensed from the package, the connection between the overlayer and underlayer is reestablished to close the package. In the case of a mechanical connector, the interlocking members are aligned and pressed together to reunite them and close the wrap. Where the connector is an adhesive, the package is reclosed simply by drawing the overlayer back around the remaining sticks and pressing it down against the underlayer so the two adhere together.

If the width of the wrapping film is greater than the length of the bundle, the film can be gathered and closed around the bundle ends. In a preferred arrangement, the film is a heat-sealable film. Heat sealing to form an enclosure for the bundle can occur after the film is wrapped tightly about the bundle. To do this, the film wrapped around the bundle preferably is laid to a flat width at each end of the bundle and heat sealed. As an alternative, the film can be formed to a bottom or side sealed bag prior to loading with shirred sticks. In either case the film still is transversely pulled tight around the bundle to secure the sticks together by radial pressure and the open bag ends are overlapped so as to provide a loose flap along the length of the bundle, which, as noted above, is pulled to open the package. Another alternative is to form the film into the shape of a tube using the adhesive tape as a longitudinal seam and then insert the bundle of sticks into the tube. The ends of the tube are heat sealed to enclose the bundle. In each case as noted above, the container formed by the wrapping film is wide enough so that once the package is opened, the ends of the sticks are free of the film and can dispense freely.

The apparatus for forming the package requires a trough having a base and upstanding side walls. The included angle between the base and each side wall is 120° so the walls diverge outwardly from the base. This trough forms the stack and supports the sticks until they are bundled together.

In conventional practice, there generally are fifty (50) sticks in each bundle. For most sizes of casing, fifty sticks of shirred casing will weigh about 15–25 pounds so this weight is convenient to lift manually. Of course the total stick count in a bundle may be reduced if the casing is a size where a bundle of fifty sticks is excessively heavy or the stick count may be increased if a bundle of fifty sticks is relatively light. U.S. Pat. No. 5,137,153 discloses arranging fifty (50) sticks in a bundle which is hexagonal-like in cross section, but is missing a stick at two diametrically opposite apexes. Thus, the bundle arrangement disclosed in the '153 Patent is two sticks short of completely filling out a hexagonal shape so there are vacancies at two locations about the periphery bundle. For purposes of the present invention, a hexagonal form is used so that the full count of fifty sticks are arranged in a hexagonal shape which has no voids about its periphery due to missing sticks. This provides a compact and stable packaging arrangement.

A preferred bundle shape is disclosed in copending U.S. patent application Ser. No. 08/030,923. The sticks in this bundle are arranged in seven (7) rows wherein the first five rows each contain one more stick than the row below, and the next two (2) rows each contain one less stick than the row below. In this configuration the fifth (5th) row contains the greatest number of sticks.

Assembling the sticks into the desired bundle shape may be accomplished by loading sticks into a trough so the longitudinal axes of the sticks are parallel and the ends of the sticks are generally coplanar. The sticks first will cover the base of the trough between the side walls and this forms a first row of sticks. Preferably, the width of the trough base is selected so only five sticks are accommodated in the first row between the side walls. Sticks which are next loaded into the trough generally will arrange themselves one against another and against the trough walls until the trough is filled or until a desired number of rows has accumulated. With the walls arranged as noted above, the sticks in each row will number one more than the row below. After the fifth row, which will contain nine (9) sticks, the next two rows are arranged so there is one less stick in each row than the row below. This may require some manual manipulation of the sticks. For example, should the sixth row fill out to a full ten (10) sticks, then two of these sticks must be relocated to the seventh row to provide a stack which in transverse cross section is a hexagon. The top row of the stack of such configuration contains only seven (7) sticks and is parallel to the base of the trough. The stack can then be pushed from the trough and wrapped in film which is pulled tight around the stack. The ends of the film are overlapped and releasably bonded together as noted above. Portions of the wrapping film then are closed over the ends of the bundle to form a bag. As an alternative, the wrap can be laid into the trough before loading in the sticks and then pulled tight around the stack in the trough. Also, rather than sealing the ends of the wrap as a last step to form a bag, the sticks can be laid directly into a preformed bag draped in the trough.

Accordingly, the package of tubular shirred sticks of food casing of the present invention is characterized by:

a) a plurality of tubular shirred sticks of food casing all of substantially equal length and diameter arranged in a stack with the longitudinal axes of the sticks parallel and the stick ends coplanar, the sticks being arranged in rows piled one on another with the number of rows and sticks in each row being selected such that the stack has a desired shape in transverse cross section;

b) a retainer disposed in tension transversely around the stack and pressing radially inward against the periphery of the stack for bundling the sticks together and securing the desired shape of the stack, the retainer having an inner surface disposed against the stack periphery and an outer surface;

c) the retainer having opposite ends which overlap along one side of the stack, the overlapped ends defining an underlayer portion against the stack periphery and an overlayer portion superimposed on the underlayer;

d) connector means releasably uniting said opposite ends, said connector means being in contact with the inner surface of the overlayer and with the underlayer to provide a releasable bond for holding the opposite ends of the retainer together and maintaining the retainer in tension about the stack; and e) the overlayer portion having an outer margin which is free of said connector means and loose from the underlayer, and the outer margin comprising means for grasping and pulling the overlayer for separating said connector means to open the package.

In another aspect, the present invention is characterized by a packaging method comprising the steps of:

a) arranging a plurality of tubular shirred sticks of food casing, each of generally the same length and diameter, in a stack with the longitudinal axes of the sticks parallel and the stick ends coplanar, the stack having a desired shape in transverse in cross section;

b) disposing a retainer in tension transversely around the stack to exert a radial inward pressure on the stack for bundling the sticks together, the retainer having an inner surface disposed against the stack periphery and an outer surface;

c) overlapping opposite ends of the retainer, the overlapped ends defining an underlayer portion against the stack and an overlayer portion superimposed on the underlayer;

d) releasably connecting the inner surface of the overlayer to the underlayer for holding the opposite ends of the retainer together and maintaining the retainer in tension about the stack; and e) providing an outer margin of the overlayer which is free and loose from the underlayer, the outer margin comprising means for grasping and pulling the overlayer and separating it from the underlayer to open the package.

DETAILED DESCRIPTION OF THE INVENTION

Figure 1:
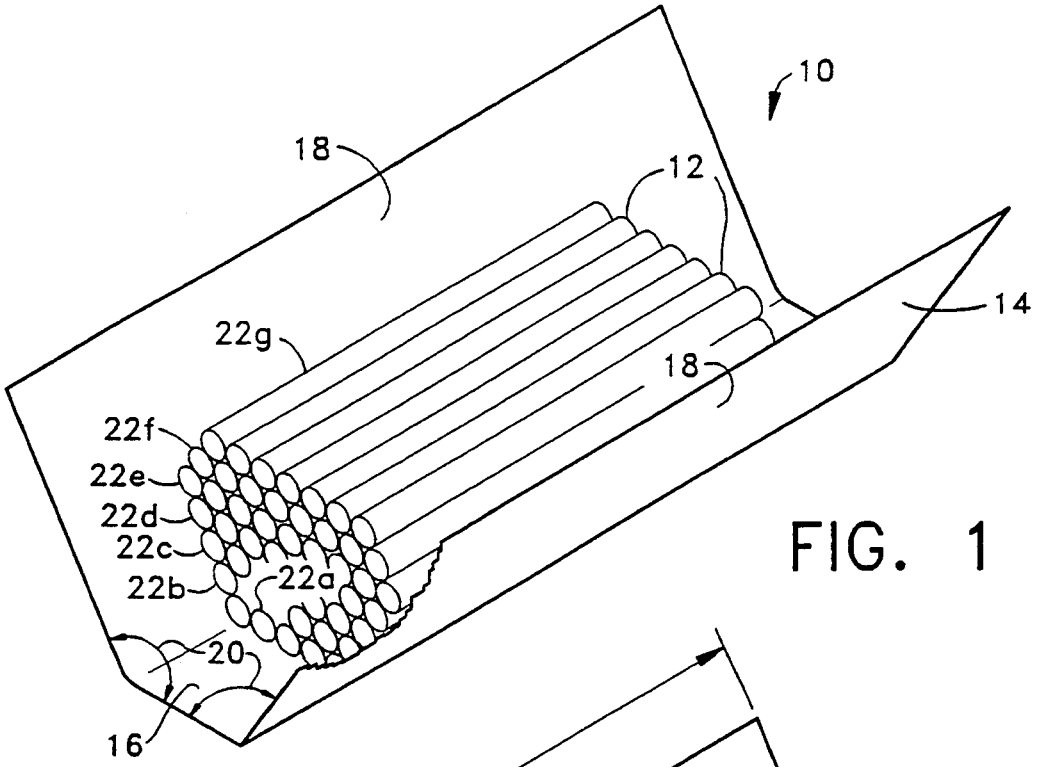
FIG. 1–3 are perspective views showing a sequence of steps in fabricating the package of the present invention.

Referring to the drawings, FIG. 1 shows a stack, generally indicated at 10, consisting of a plurality of sticks 12. As shown, the sticks in the stack have their longitudinal axes parallel and the ends of the sticks are generally coplanar. The sticks, as shown, are located in a trough 14. The trough has a base 16 and upstanding sidewalls 18. The included angle 20 between the base and each wall is about 120° so the walls flare outwardly. The sticks are placed into the trough so they stack on one another and generally form themselves into a preferred stack arrangement. In this respect, a preferred stack has a hexagonal cross section. This stack, as shown in FIG. 1, has seven rows 22*a–g* of sticks stacked on one another. Starting from the bottom, each of the four rows 22*b–e* contains one more stick than the row below. Each of the next two rows 22*f, g* contains one less stick than the row below. If the width of the base 16 is sufficient to accommodate five sticks in the first row 22*a*, this means the stack of seven rows will contain fifty (50) sticks.

The trough is utilized to assist in forming the desired hexagon shape. Sticks, as they are produced are discharged into the trough and fill the space between the outwardly flared walls 18. Since the included angle 20 between each wall and the base is 120°, the sticks will fall into the desired pattern wherein each row contains one more stick than the row below. When fifty sticks are loaded, the upper two rows 22*f* and *g* are manually arranged to provide the decreasing stick count in each row as described hereinabove. This provides a stack having the desired shape in transverse cross section. The shape is an abbreviated version of a regular hexagon in that it has six sides, three of which are of equal length, and all included angles are 120°. However, the stack lacks the two additional rows required to form a regular hexagon in cross section wherein all sides are equal.

Figure 2:
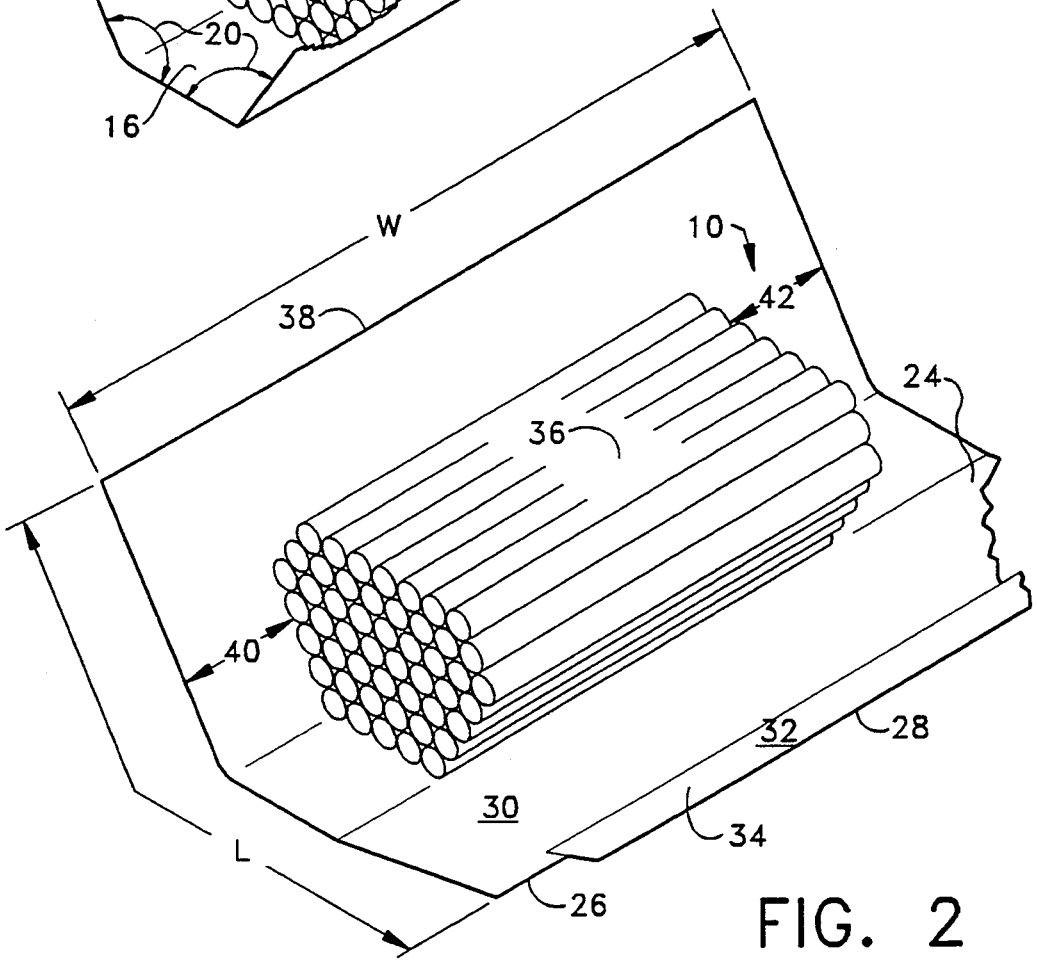

Once the stack is formed, the loose sticks are tightly bundled together. FIG. 2 shows the stack 10 located on a plastic film wrapper 24. The film can be any plastic film conventionally used in packaging applications and could be either a stretch or heat shrink film. For example suitable films include a 3 mil low density polyethylene film.

Preferably, the wrapper 24 has a length "L" which is longer than the perimeter of the stack and a width "W" which is greater than the stack length. This will facilitate enclosing the stack including closing over the ends of the stack as further described hereinbelow.

Adhered along one end 26 of the wrapper is a strip of adhesive tape 28. The tape 28 is a single sided tape such as a Patco Corporation tape No. 503A.

Figure 3:
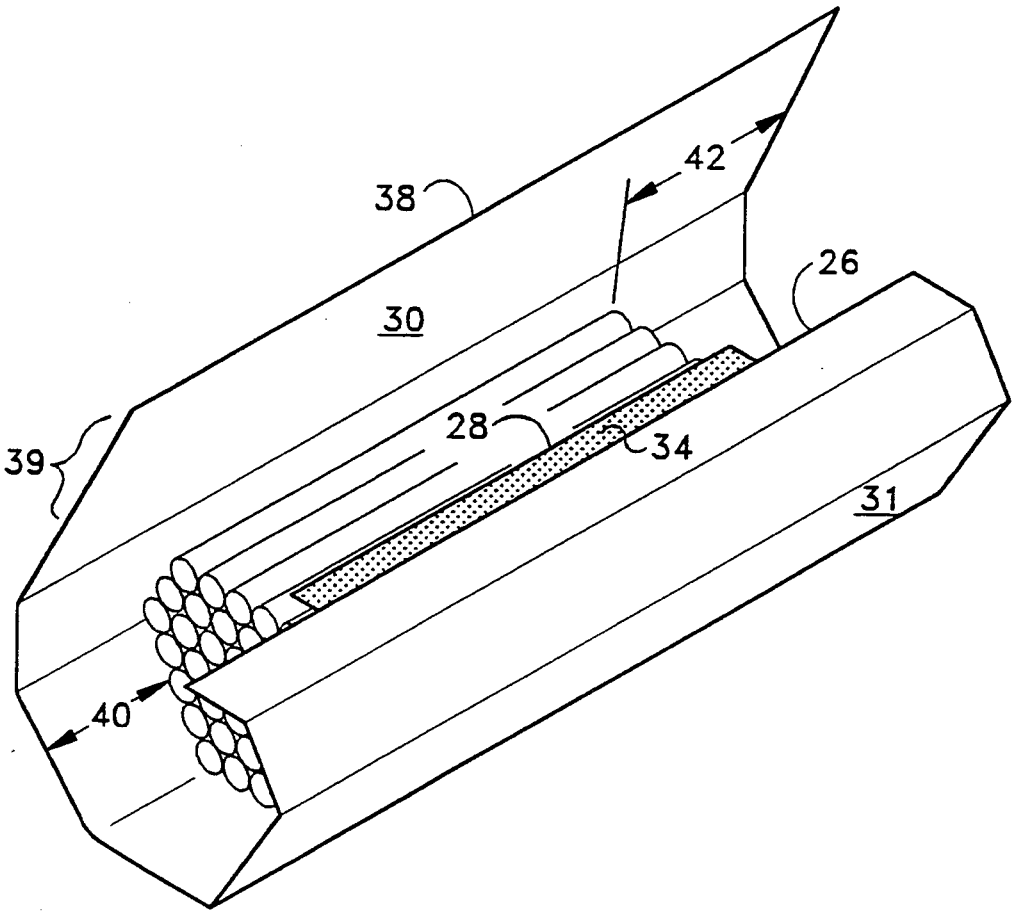

The tape is laid along the edge of wrapper end 26 and one half of the tape width is adhered to the inner surface 30 of the wrapper for about the length of the stack. As used herein, the wrapper inner surface 30 is the wrapper surface which directly contacts the stack and the opposite wrapper surface is the outer surface 31 (FIG. 3). Since the tape is one sided, this means the nonstick surface 32 of the tape faces inward toward the stack and the adhesive surface 34 of the tape faces outward.

The wrapper end 26 is laid flat on the top 36 of the stack so the portion of the adhesive surface 34 extending outward from the wrapper end 26 is exposed. The opposite end 38 of the wrapper is pulled tight around the stack and up over the exposed portion of the adhesive surface 34 so the wrapper exerts radial inward pressure on the stack (FIG. 3).

Figure 6:
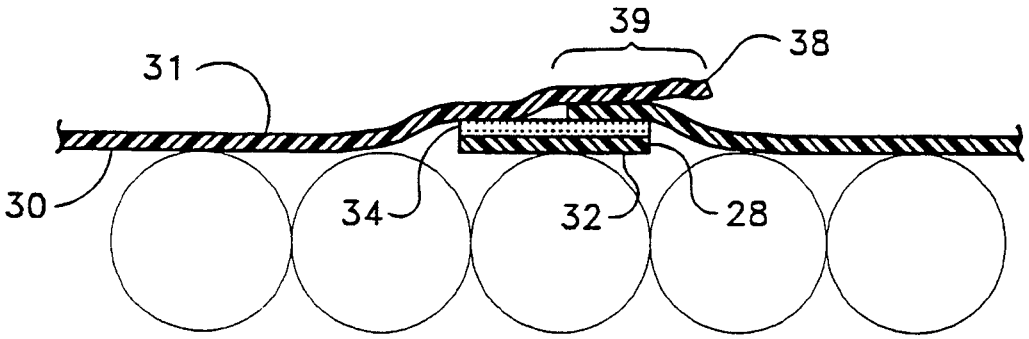
FIG. 6 is a cross sectional view on an enlarged scale showing a portion of the package of the present invention.
Figure 9:
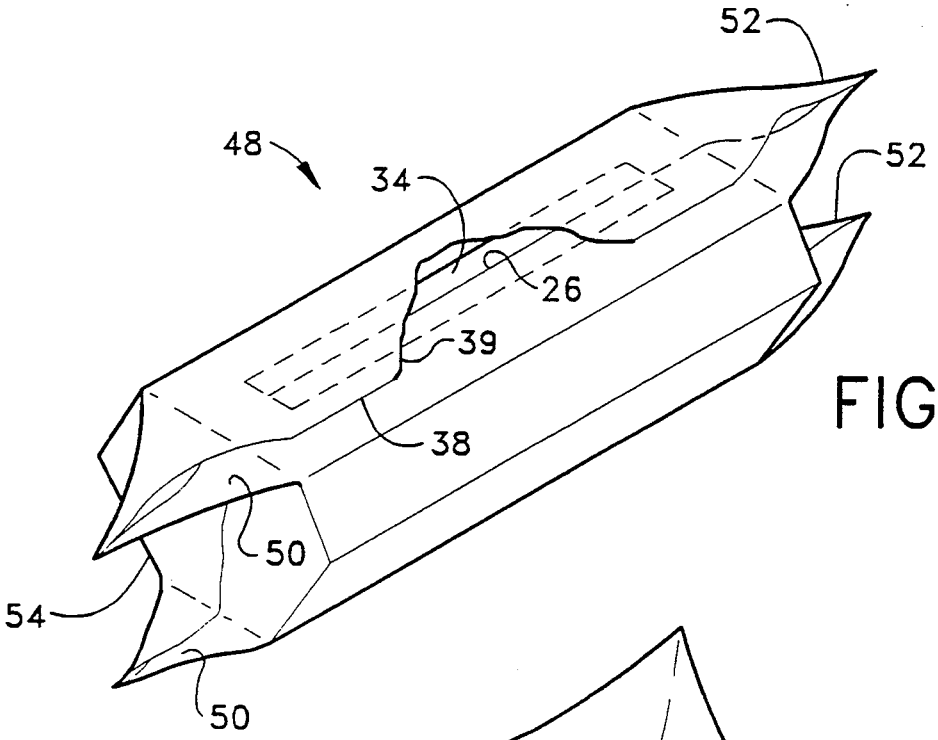
FIG. 9 is a perspective view showing a completed package of the present invention.

As noted above, the length "L" of the wrapper is greater than the perimeter of the stack. Accordingly, pulling the wrapper tight about the stack overlaps the wrapper ends 26, 38. Wrapper end 26 containing the adhesive tape 28 is the underlayer and wrapper end 38 is the overlayer. While the wrapper is held in tension about the stack, the overlayer is pressed down so the inner surface 30 of the wrapper adjacent wrapper end 38 attaches to the adhesive surface 34 of the tape (FIGS. 6 and 9).

Since the wrapper end 38 overlaps end 26, an outer margin portion 39 of the overlayer is free of the adhesive 34 and loose from the underlayer.

Figure 7:
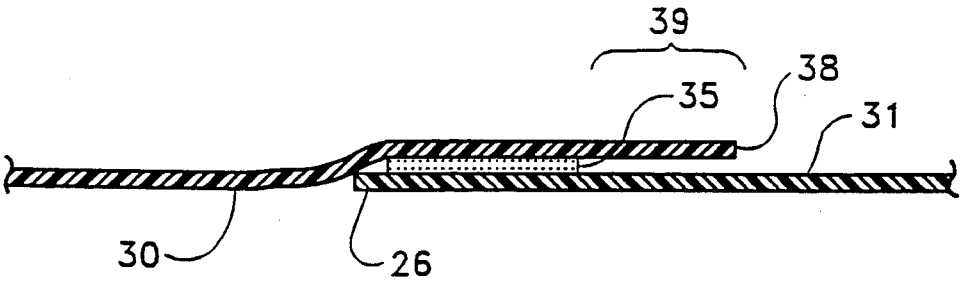
FIGS. 7 and 8 are views similar to FIG. 6 only showing alternative embodiments.

An alternative embodiment which provides a similar arrangement is shown in FIG. 7. Here a double sided tape 35 is placed on the outer surface 31 along the wrapper end 26. When wrapper end 38 is pulled over and pressed down against the double sided tape 35, an outer margin 39 of the overlayer is left free of the adhesive and loose from the underlayer.

In either case, the adhesive 34, 35 is in contact with the inner surface 30 of the overlayer adjacent end 38 and with the underlayer along end 26 and this adherence keeps the wrapper tight about the sticks and maintains the desired stack configuration.

It has been found that sticks oriented in the hexagon as shown provide a relatively stable stack. In this respect, the sticks do not readily displace within the stack responsive to the radial pressure exerted by the wrapper. In contrast, a rectangular arrangement of sticks is more likely to collapse when tightly wrapped. This happens because the pressure exerted on the sticks at each of the four corners of the rectangle pushes these sticks radially inward which outwardly displaces sticks located towards the middle of each side.

Figure 4:
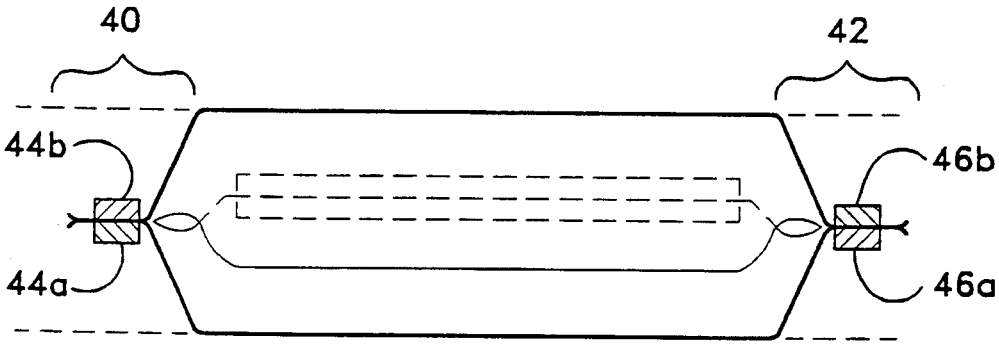
FIGS. 4 and 5 are top and side elevation views respectively showing heat sealing of the package ends.
Figure 5:
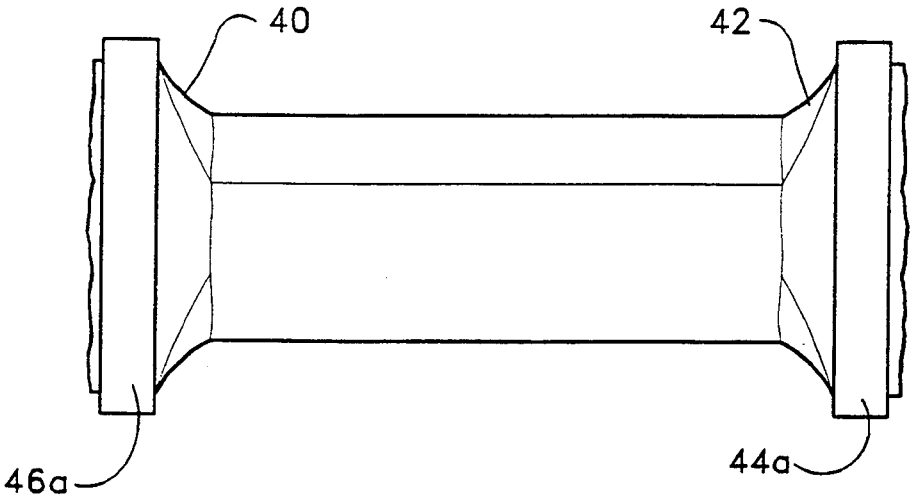

When the wrapper is in place about the stack, the lateral portions 40, 42 of the wrapper at each end of the stack (FIGS. 2 and 3) are closed. This can be done by heat sealing. As shown in FIGS. 4 and 5, heat seal bars 44*a, b* and 46*a, b* close against the wrapper. This gathers the lateral portions 40, 42 to a flat width for heat sealing.

The completed package 48 is shown in FIG. 9. As a result of the flat width heat sealing of the wrapper as disclosed herein, pairs of tabs 50, 52 of the wrapper material are formed at each end of the package. These can be folded down against the ends 54 of the container.

It is convenient to stand a plurality of packages 48 on end in a carton for shipment or they can be bound together with a stretch wrap. If a plurality of the packages are tightly packed on end in a carton, the tab pairs 50 or 52 on the same end of the package provide a convenient means for grasping and lifting a package 48 from the carton. Tabs 50 and 52 being at opposite ends of the carton provide convenient means for manually grasping and lifting a horizontally oriented package and carrying it into a position for dumping out the sticks.

Figure 10:
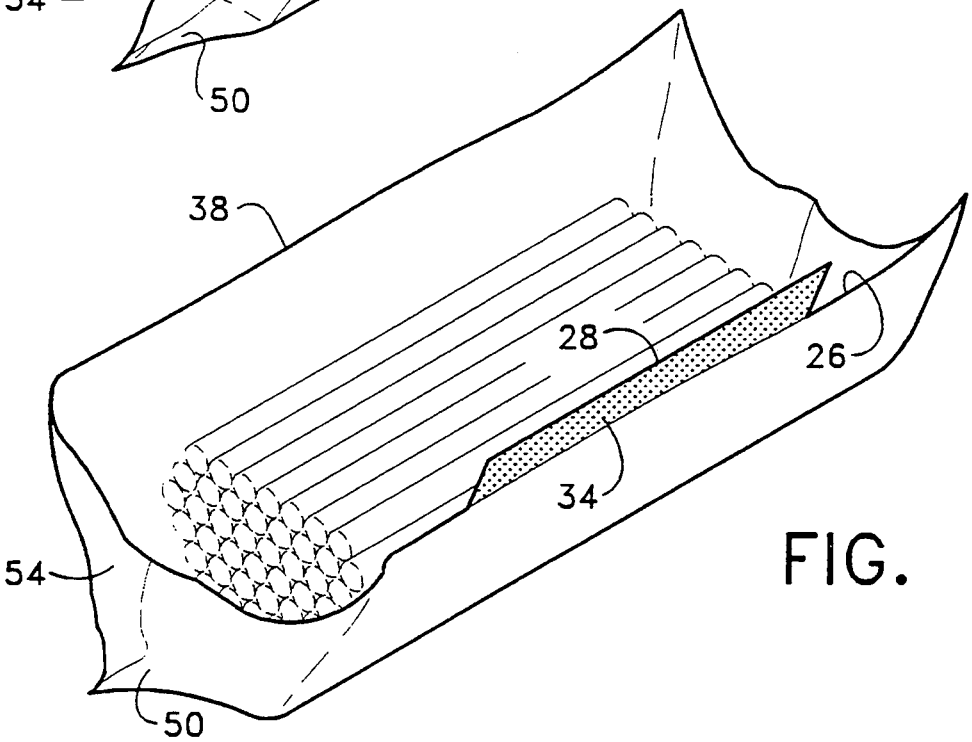
FIG. 10 is a perspective view showing a package of the present invention in an open condition.

As noted above, the outer margin 39 of the overlayer does not contact the adhesive and is loose. This loose outer margin provides a convenient means for grasping and pulling the overlayer to strip it from the adhesive, thereby opening the wrapper. As shown in FIG. 10, this allows the top of the package to open wide for the full length of the package and allows the package ends 54 to sag away from the stick ends. The sticks are no longer restrained by the wrapping and dispense freely from the package. The wide opening also allows unused stick to be returned to the package. Moreover, the tape 28 remains readily available for reclosing the wrapper tightly about the unused sticks. The features as shown in FIGS. 9 and 10 also are obtained if the film is in the form of a bag and the sticks are loaded directly into the bag. Thus, the same package configuration can be obtained using a side sealed or bottom sealed bag. In this case, film ends 26, 38 correspond to edges which define the open end of the bag. After loading the bag, these ends 26, 38 are pulled one over the other as described hereinabove to tighten the bag about the bundle.

The method steps described at FIG. 1 and 2 show the stack removed from the trough for wrapping. It should be appreciated that the wrapper 24 can be laid in the trough prior to the placement of sticks in the trough. This will allow wrapping to occur within the trough. If, as noted above, the wrapper is in the form of a side sealed or bottom sealed bag, the heat sealing steps of FIGS. 4 and 5 are eliminated.

While it is preferred that the wrapper encloses the end of the stack, the bundling together of the sticks by an easy-to-open and recloseable connector as disclosed also can be provided with a wrap having a length "W" less than the stack length. In such an arrangement the stack ends would be open. Also, if the wrapper is made of a stretch film, its length "L" prior to wrapping can be smaller than the stack perimeter. This shorter wrap would be stretched about the stack so its final length after uniting the opposite ends 26, 38 would be longer than the stack perimeter.

Figure 8:
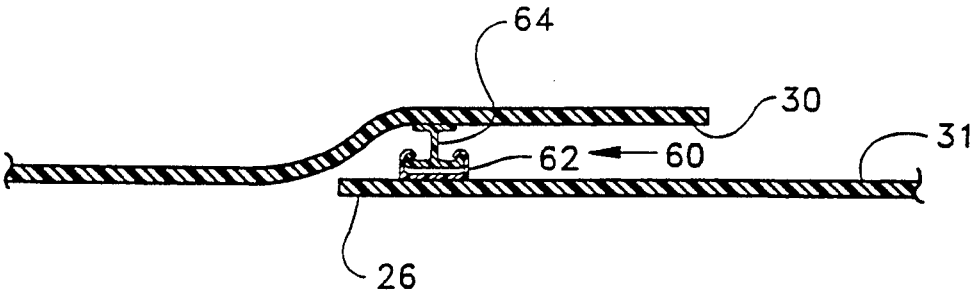

FIG. 8 illustrates an alternative embodiment wherein the connector means is in the form of a mechanical connector 60. The mechanical connector comprises an interlocking male-female closure commonly found in strips on bags or the like. As used in the present invention one of the connector elements 62 is welded or otherwise adhered to the outer surface 31 of the wrapper adjacent end 26. The other element 64 of the interlocking male-female connector likewise is welded or otherwise adhered to the inner surface 30 adjacent the opposite end of the wrap. The interlocking closure maintains the wrap taught about the stock, and is easily opened and reclosed.

Thus, it should be appreciated that the present invention provides a conventional package of fifty (50) shirred sticks which is easy to make without the use of corrugated packaging materials. The package tightly bundles the stick together, has an easy to-open-means provided by the loose outer margin 39 and can be reclosed using the connector means provided by the adhesive arrangements shown in FIGS. 6 and 7 or the mechanical interlocking closure shown in FIG. 8. In all instances, the connector remains associated with the wrapper to facilitate reclosing the package. Even though the package is made by tightly wrapping about the sticks, the resulting bundle is relatively stable due to the hexagon configuration of the stack. Also the pairs of tabs 50, 52 at each end of the package ends provides convenient hand holds for lifting and carrying the package.

Having described the invention in detail, what is claimed as new is:

1. A package of tubular shirred sticks of food casing comprising:

a) a plurality of tubular shirred sticks of food casing all of substantially equal diameter arranged in a stack with the longitudinal axes of the sticks parallel to form sides of said stack and the stick ends coplanar to form ends of said stack, said sticks being arranged in rows piled one on another with the number of rows and sticks in each row being arranged to provide said stack with a preselected shape in transverse cross section;

b) a retainer disposed in tension transversely around said stack and pressing radially inward against the periphery of said stack for bundling said sticks together and securing the shape of said stack, said retainer having an inner surface disposed against the stack periphery and an outer surface;

c) said retainer having a first end and an opposite second end which extend generally parallel to the longitudinal axes of said sticks and which overlap along one side of said stack, said first end defining an underlayer against said stack and said second end defining an overlayer superimposed on said underlayer;

d) connector means releasably uniting said underlayer to said overlayer, said connector means being in direct contact with the inner surface of said overlayer and with said underlayer for holding said retainer first and second ends together and maintaining said retainer in tension about said stack; and e) said overlayer having an outer margin portion extending along said second end substantially parallel with said connector means which is free of said connector means and loose from said underlayer, and said outer margin portion comprising means for grasping and pulling said overlayer for separating said connector means to open said package.

2. A package as in claim 1 wherein said connector means is a single sided adhesive tape having an adhesive surface adhered to the inner surface of said underlayer along said first end, and a portion of said adhesive surface extending out from said first end and in adhering contact with the inner surface of said overlayer.

3. A package as in claim 1 wherein said connector means is an adhesive disposed between said overlapped ends and in direct contact with the outer surface of said underlayer and the inner surface of said overlayer.

4. A package as in claim 3 wherein said adhesive is a double sided adhesive tape.

5. A package as in claim 1 wherein said connector means is a releasable interlocking closure including a male member and a female member, one of said members being fixed to the inner surface of said overlayer and other of said members being fixed to the outer surface of said underlayer.

6. A package as in claim 1 wherein said retainer is a stretch wrap film.

7. A package as in claim 1 wherein said retainer is a wrapper of a heat sealable material having a width greater than the length of said stack and said wrapper being closed at each end of said stack by a heat seal.

8. A package as in claim 7 wherein said wrapper is in the form of a bag having side seals adjacent each end of said stack, said side seals forming tabs extending from the opposite ends of said package and said tabs comprising means for grasping and lifting said package.

9. A package as in claim 1 wherein said stack is hexagonal in transverse cross section.

10. A package as in claim 9 wherein said stack is made up of seven rows of sticks wherein each of the second through fifth rows contains one more stick than the row below and the next two rows contain one less stick than the row below.

11. A package as in claim 10 wherein said package contains fifty sticks and the first row of said stack contains five sticks.

12. A package of tubular shirred sticks of food casing comprising:

a) a plurality of tubular shirred sticks of food casing all of substantially equal diameter arranged in rows stacked one on another to form a desired shape in cross section;

b) a bag composed of heat sealable plastic film having an inner surface disposed against said stack, an outer surface and a width greater than the length of said stack, said bag containing said shirred sticks, and said bag disposed in tension transversely round said stack for bundling said sticks together and securing said stack in said desired shape;

c) said bag having first and second edges which define an open end of said bag, said edges overlapping along the length of said stock to provide respectively an underlayer and an overlayer which close said open end;

d) a single sided adhesive tape arranged along said first edge and bonded to said overlayer and underlayer to hold them together and maintain said bag in tension about said stack;

e) said adhesive tape being a single sided tape having a backing disposed against said stack and an adhesive surface adhered to said inner surface along said underlayer, a portion of said adhesive tape extending out from said first edge such that the adhesive thereof is in adhering contact with said inner surface along said overlayer; and f) said overlayer having an outer margin along said second edge which is free of said adhesive and loose from said underlayer, said loose outer margin comprising means for grasping and pulling said overlayer free of said adhesive for opening said package.

13. A package as in claim 12 wherein said bag is a side sealed bag.

14. A package as in claim 12 wherein said bag is a bottom sealed bag.

15. A package as in claim 12 wherein said stack has seven rows with a lowermost row containing five sticks and each of the next four rows containing one more stick than the row below and the upper two rows each containing one less stick than the row below, and the rows being arranged in said stack to form a hexagon in transverse cross section wherein each internal angle of said hexagon is 120°.

16. A method of forming a package of containing a plurality of tubular shirred sticks of food casing comprising the steps of:

a) arranging a plurality of tubular shirred sticks of food casing, each substantially the same diameter, in a stack with the longitudinal axes of the sticks parallel to form sides of the stack and the stick ends coplanar to form ends of the stack, the sticks being in rows piled on one another with the number of rows and number of sticks in each row arranged to provide said stack with a preselected shape in transverse cross section;

b) disposing a retainer in tension transversely around the sides of the stack to exert a radial inward pressure on the stack for bundling the sticks together, the retainer having an inner surface disposed against the stack periphery and an outer surface;

c) overlapping opposite ends of the retainer, a first of the overlapped ends defining an underlayer against the stack and a second of the ends defining an overlayer superimposed on the underlayer;

d) releasably connecting the inner surface of said overlayer to said underlayer for holding the opposite ends of the retainer together and maintaining the retainer in tension about the stack; and e) providing an outer margin portion of the overlayer extending along said second end which is free and loose from the underlayer, the outer margin portion comprising means for grasping and pulling the overlayer and separating it from the underlayer to open the package.

17. A method as in claim 16 wherein said step of releasably connecting comprises adhesively bonding the outer surface of said underlayer to the inner surface of said overlayer.

18. A method as in claim 17 wherein said adhesive bonding comprises adhering one side of a double sided adhesive tape to the outer surface of said underlayer and adhering the inner surface of said overlayer to a second side of said double sided tape.

19. A method as in claim 16 wherein said adhesive bonding comprises adhering the adhesive surface of a single sided adhesive tape to the inner surface of said underlayer such that a portion of said adhesive surface extends from said underlayer and adhering said portion to the inner surface of said overlayer.

20. A method as in claim 16 comprising arranging said sticks in seven rows stacked one on another, the lowermost row containing five sticks and each of the next four rows containing one more stick than the row below and each of the next two rows containing one less stack than the row below such that said preselected transverse cross sectional shape is a hexagon and all internal angles of said hexagon are 120°.

21. A method as in claim 16 wherein said retainer is a heat sealable plastic film wider than the length of said stack and heat sealing the inner surface of said retainer to itself at each end of said stack to enclose said stack.

22. A method as in claim 21 wherein said heat sealing occurs prior to disposing said retainer about said stack.

* * * * *